US007967163B1

(12) United States Patent
Martin

(10) Patent No.: US 7,967,163 B1
(45) Date of Patent: Jun. 28, 2011

(54) PRE-FILLED DISPOSABLE CONTAINER

(76) Inventor: George E. Martin, Midland, TX (US)

( * ) Notice: Subject to any disclaimer, the term of this patent is extended or adjusted under 35 U.S.C. 154(b) by 309 days.

(21) Appl. No.: 12/061,596

(22) Filed: Apr. 2, 2008

(51) Int. Cl.
*B65D 41/32* (2006.01)
*B65D 35/14* (2006.01)
*B65D 47/02* (2006.01)

(52) U.S. Cl. ..... 220/495.06; 220/23.91; 220/265; 220/266; 220/270; 220/495.01; 220/495.03; 220/495.05; 215/11.1; 215/11.3; 215/11.4; 215/11.5; 215/11.6; 215/12.1; 215/14; 215/15; 215/250; 215/253; 215/254

(58) Field of Classification Search ..... 220/23.86, 220/23.91, 265, 266, 270, 495.01, 495.03, 220/495.05, 495.06, 601; 215/11.1, 11.3–11.6, 215/12.1, 14, 15, 250, 253, 254, 395, 396
See application file for complete search history.

(56) References Cited

U.S. PATENT DOCUMENTS 3,292,809 A * 12/1966 Shomock et al. ..... 215/11.5
3,735,888 A * 5/1973 Jacko ..... 215/11.5
4,895,264 A * 1/1990 Phlaphongphanich ..... 215/11.1
5,579,935 A 12/1996 Atkin et al.
6,171,623 B1 * 1/2001 Gaylor et al. ..... 426/117
6,601,720 B2 * 8/2003 Meyers et al. ..... 215/11.5
7,100,782 B2 * 9/2006 Hanna ..... 215/11.6

* cited by examiner

*Primary Examiner* — Anthony Stashick
*Assistant Examiner* — Madison L Wright
(74) *Attorney, Agent, or Firm* — Eric Karich

(57) ABSTRACT

A pre-filled disposable container has a rigid tubular body, a flexible bag positioned within the rigid tubular body, a cap, and a base sealing element. The rigid tubular body has an open-ended top and an open-ended bottom. The flexible bag has a top portion with a dispensing aperture, a bottom portion, and an outwardly extending annular flange. An annular retaining ring is adapted to lock the outwardly extending annular flange of the flexible bag against a top rim of the rigid tubular body. The cap is adapted to fit over the top portion of the flexible bag. A tear strip removably connects the cap and the annular retaining ring. The base sealing element is adapted to engage the open-ended bottom of the rigid tubular body to seal a vacuum aperture.

2 Claims, 3 Drawing Sheets

PRE-FILLED DISPOSABLE CONTAINER

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to fluid containers, and more particularly to a pre-filled disposable container for containing and dispensing juices, milk, and other drinks, particularly for children.

2. Description of Related Art

Baby feeding bottles are known in the art. The baby feeding bottles include nipples for enabling the baby to drink, either directly from the bottle, or from a disposable liner. However, the prior art baby bottles typically are mixed immediately prior to use.

The prior art teaches baby feeding bottles that may be prepared immediately prior to use. However, the prior art does not teach a pre-filled disposable container that is sold in a pre-mixed form. The present invention fulfills these needs and provides further related advantages as described in the following summary.

SUMMARY OF THE INVENTION

The present invention teaches certain benefits in construction and use which give rise to the objectives described below.

The present invention provides a pre-filled disposable container having a rigid tubular body, a flexible bag positioned within the rigid tubular body, a cap, and a base sealing element. The rigid tubular body has an open-ended top and an open-ended bottom, the open-ended top having a top rim, and the open-ended bottom having a vacuum aperture adjacent a bottom rim. The flexible bag has a top portion with a dispensing aperture, a bottom portion, and an outwardly extending annular flange. An annular retaining ring is adapted to lock the outwardly extending annular flange of the flexible bag against the top rim of the rigid tubular body. The cap is adapted to fit over the top portion of the flexible bag and engage the annular retaining ring. The base sealing element is adapted to engage the open-ended bottom of the rigid tubular body and move between a first position, wherein the open-ended bottom is sealed closed, but the vacuum aperture is open, and a second position, wherein both the open-ended bottom and the vacuum aperture are sealed closed.

A primary objective of the present invention is to provide a pre-filled disposable container having advantages not taught by the prior art.

Another objective is to provide a container that enables a drink to be sold pre-mixed, in a sterile container that is disposable.

A further objective is to provide a container that is inexpensive to manufacture and fill.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a pre-filled disposable container 10 for containing and dispensing juices, milk, and other drinks, particularly for children.

Figure 1:
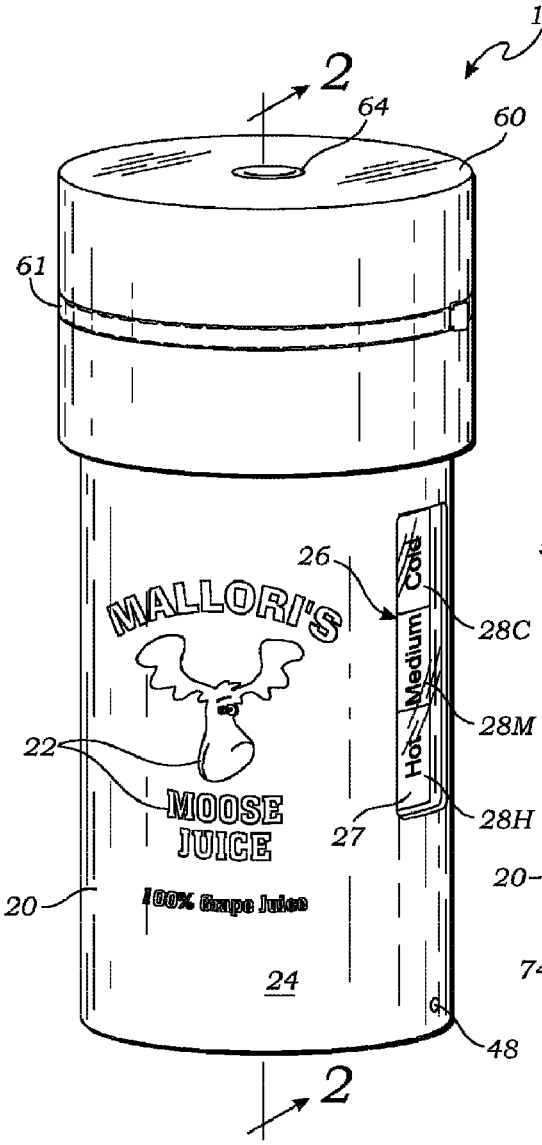
FIG. 1 is a perspective view of a pre-filled disposable container according to one embodiment of the present invention.

FIG. 1 is a perspective view of the pre-filled disposable container 10 according to one embodiment of the present invention. As shown in FIG. 1, the pre-filled disposable container 10 includes a rigid tubular body 20 and a cap 60. A printed element 22 decorates an outer surface 24 of the pre-filled disposable container 10 and may describe the contents. The particular size and shape of the pre-filled disposable container 10 will vary depending upon the needs of the target consumer.

In one embodiment, the pre-filled disposable container 10 includes a transparent window 27 through the rigid tubular body 20 for viewing a heat sensitive strip 26 located on the flexible bag 30. The heat sensitive strip 26 is used for indicating the temperature of the contents of the pre-filled disposable container 10. In one embodiment, the heat sensitive strip 26 includes a cold portion 28C that reacts to colder temperatures, a medium portion 28M that reacts to medium temperatures, and a hot portion 28H that reacts to hot temperatures. The specific construction of the heat sensitive strip 26, and the temperatures sensed, will vary according to the needs of the consumer, but in one embodiment, the cold portion 28C will react to any temperatures that are below the preferred consumption temperature of the contents of the pre-filled disposable container 10, and the hot portion 28H will react to any temperatures that might harm or cause discomfort to a child consuming the contents of the pre-filled disposable container 10.

Figure 2:
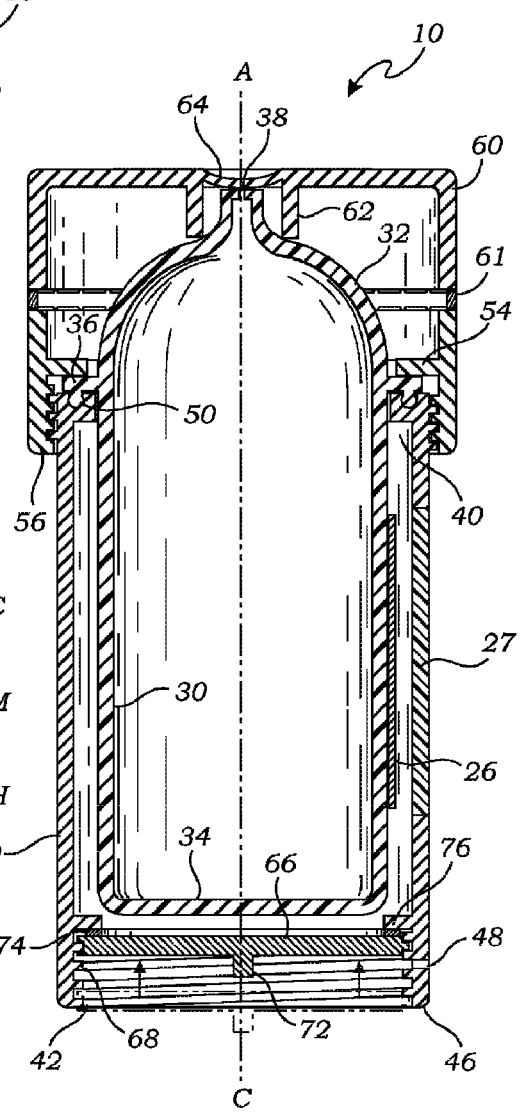
FIG. 2 is a sectional view thereof taken along line 2-2 in FIG. 1.
Figure 3:
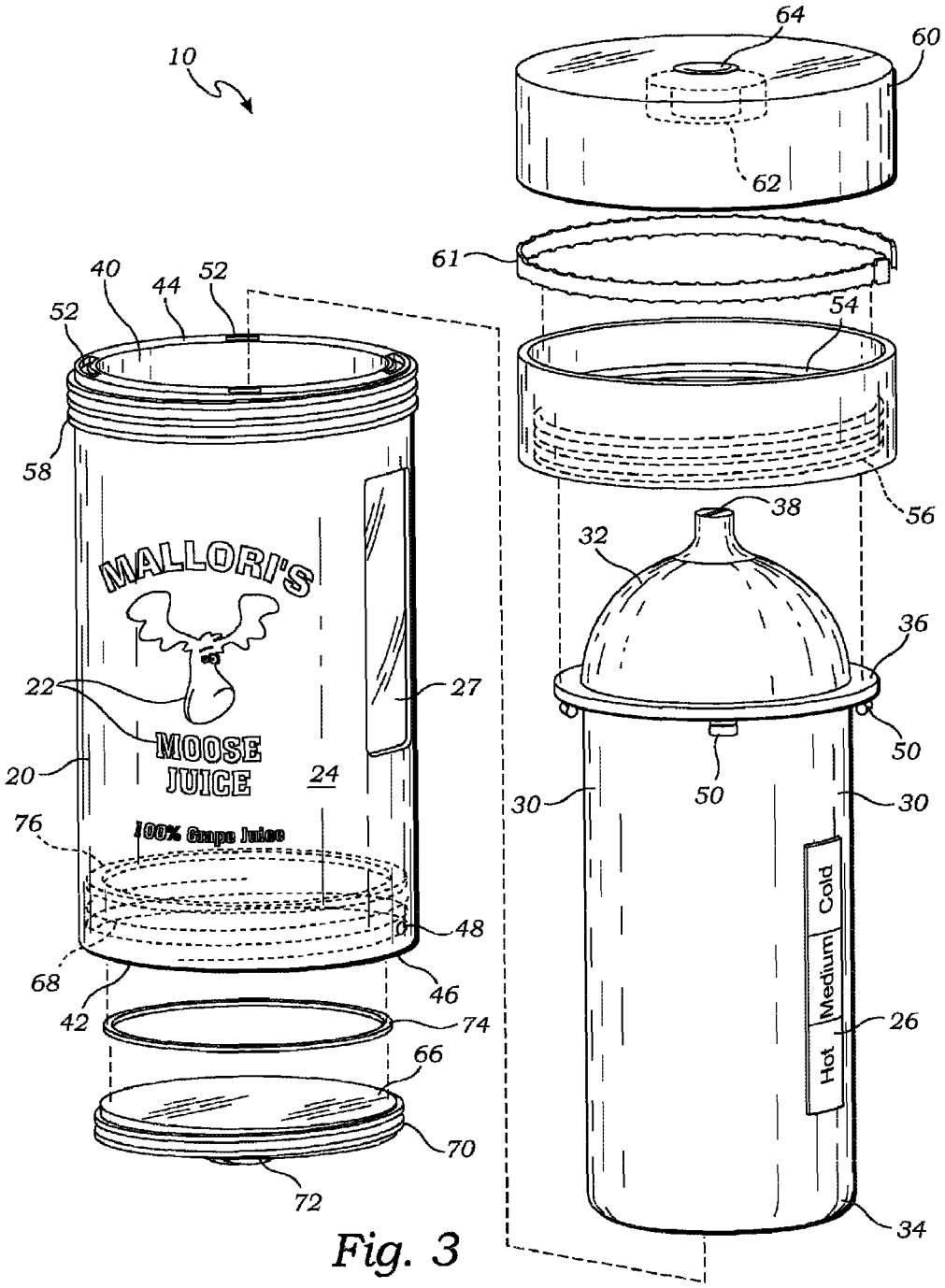
FIG. 3 is an exploded perspective view of the pre-filled disposable container.

FIG. 2 is a sectional view of the pre-filled disposable container 10 taken along line 2-2 in FIG. 1. FIG. 3 is an exploded perspective view of the pre-filled disposable container 10, illustrating the various components of the pre-filled disposable container 10. As illustrated in FIGS. 2 and 3, the pre-filled disposable container 10 includes a flexible bag 30 having a top portion 32, a bottom portion 34, and an outwardly extending annular flange 36. The top portion 32 includes a dispensing aperture 38 for dispensing the contents of the pre-filled disposable container 10. The bottom portion 34 is adapted to be filled and sealed. The outwardly extending annular flange 36 is adapted to engage the rigid tubular body 20, as described below.

In this embodiment, the rigid tubular body 20 has an open-ended top 40 and an open-ended bottom 42. The open-ended top 40 may have a top rim 44. The open-ended bottom 42 may have a bottom rim 46, and a vacuum aperture 48 adjacent the bottom rim 46. The outwardly extending annular flange 36 is adapted to about the top rim 44. In one embodiment, the outwardly extending annular flange 36 includes a plurality of protections 50 that engage locking apertures 52 in the top rim 44 of the rigid tubular body 20.

The pre-filled disposable container 10 further includes an annular retaining ring 54 that is adapted to lock the outwardly extending annular flange 36 of the flexible bag 30 against the top rim 44 of the rigid tubular body 20 when the flexible bag 30 is positioned within the rigid tubular body 20. In one embodiment, the annular retaining ring 54 has an internally threaded portion 56 that threadedly engages an externally threaded portion 58 of the rigid tubular body 20 so that an inwardly extending portion of the annular retaining ring 54 compresses the outwardly extending annular flange 36 against the top rim 44.

As shown in FIGS. 2 and 3, the cap 60 is adapted to fit over the top portion 32 of the flexible bag 30 and engage the annular retaining ring 54. In one embodiment, the cap 60 is removably attached to the annular retaining ring 54 with a tear strip 61. The tear strip 61 can then be removed from between the cap 60 and the annular retaining ring 54 for opening the container 10.

When the disposable container 10 is manufactured, as best illustrated in FIGS. 2 and 3, the cap 60 is integrally formed with the tear strip 61 and the annular retaining ring 54. To open the pre-filled disposable container 10, the tear strip 61 is removed, allowing the cap 60 to disengage from the annular retaining ring 54.

The cap 60 may further include a downwardly projecting ring 62 that is adapted to fit around the dispensing aperture 38. In one embodiment, the dispensing aperture 38 is a feeding nipple, and in this embodiment the downwardly projecting ring 62 is shaped to fit around the feeding nipple. The cap 60 may further include a resilient dome 64. When a vacuum is applied within the pre-filled disposable container 10, as described below, the resilient dome 64 deforms downwardly and may contact the dispensing opening. When the vacuum is removed by the pre-filled disposable container 10 being opened, the resilient dome 64 "pops" back up, providing evidence that the pre-filled disposable container 10 has been opened.

As shown in FIGS. 2 and 3, the pre-filled disposable container 10 further includes a base sealing element 66 adapted to engage the open-ended bottom 42 of the rigid tubular body 20 for closing the flexible bag 30 within the pre-filled disposable container 10. The open-ended bottom 42 has a bottom inner surface 68 that is adapted to engage an outer perimeter 70 of the base sealing element 66. In one embodiment, the bottom inner surface 68 is threaded, wherein the outer perimeter 70 of the base sealing element 66 is threaded, and wherein the base sealing element 66 moves between first and second positions when the base sealing element 66 is rotated with respect to the rigid tubular body 20.

The base sealing element 66 may include a locking element 72 at a center C of the base sealing element 66, coaxial with an axis A of the tubular body 20, that enables the base sealing element 66 to be rotated, thereby moving the base sealing element 66 between the first and second positions. The locking element 72 may be, for example, a nut-shaped element that can be engaged with a tool (not shown) as part of an automatic filling and assembly process.

In one embodiment, illustrated in FIG. 2, in the first position the open-ended bottom 42 is covered by and at least mostly sealed closed by the base sealing element 66, but the vacuum aperture 48 is open and in fluid communication with the interior of the tubular body 20. When the base sealing element 66 is rotated by the locking element 72, it moves from the first position to the second position, wherein both the open-ended bottom 42 and the vacuum aperture 48 are sealed closed. An annular ledge 76 is positioned to abut the base sealing element 66 when it has reached the second position, and a gasket 74 may be positioned between the base sealing element 66 and the annular ledge 76 so that a proper seal is formed and maintained.

When the disposable container 10 is manufactured, as best illustrated in FIGS. 2 and 3, the flexible bag 30 is positioned within the tubular body 20, as described above, and the annular retaining ring is engaged with the tubular body 20 to lock the outwardly extending annular flange 36 in place. The cap 60 is positioned around the annular retaining ring 54. The flexible bag 30 is filled with the contents (milk, juice, etc.) and sealed closed. The base sealing element 66 is then engaged with the open-ended bottom 42 and moved to the first position. A vacuum is applied to the vacuum aperture 48, until most of the air has been removed from the tubular body 20 (or potentially replaced with an inert gas). The base sealing element 66 is then moved to the second position, abutting the annular ledge 76 and sealing against the gasket 74.

Figure 4:
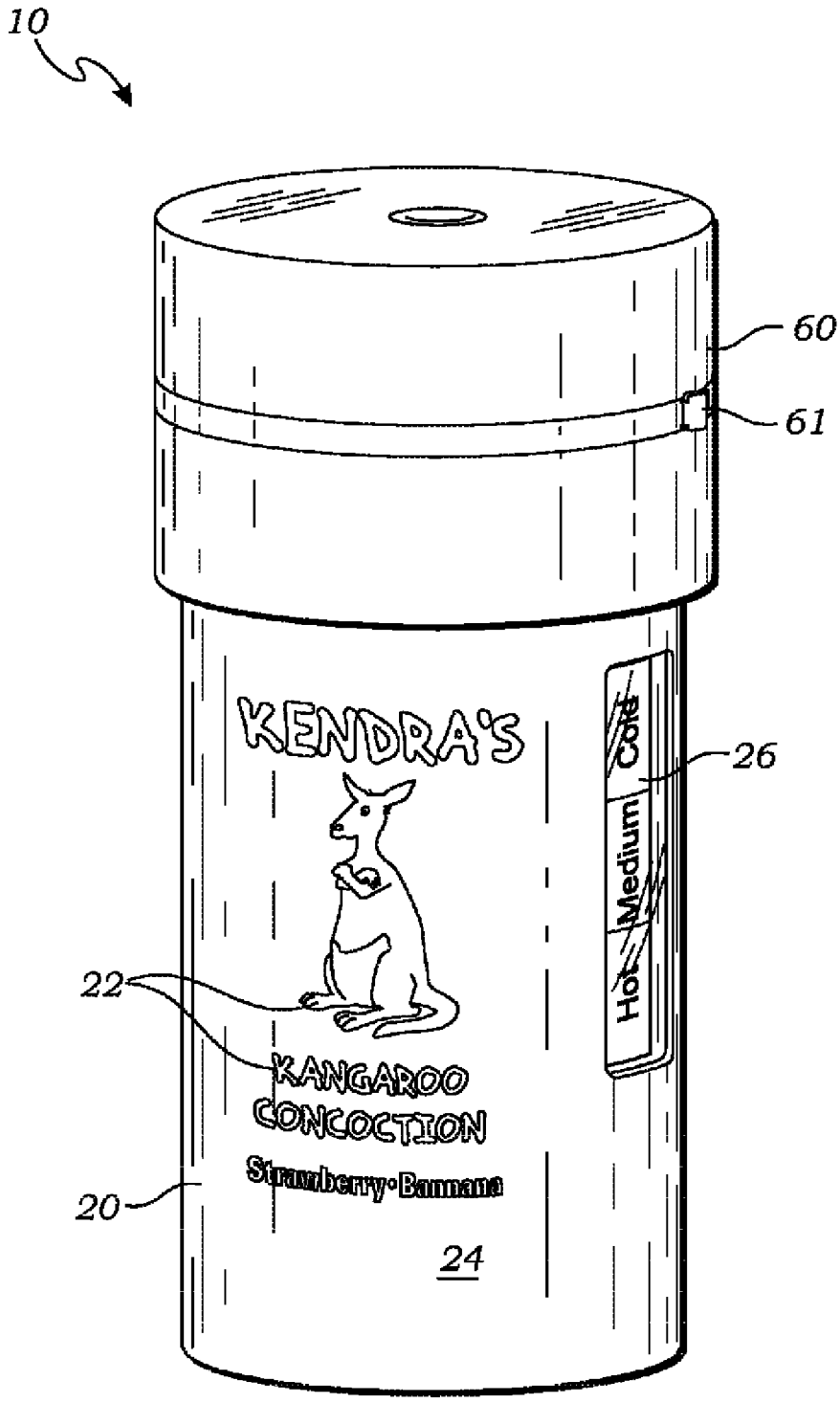
FIG. 4 is a perspective view of an alternative embodiment of the pre-filled disposable container.

FIG. 4 is a perspective view of an alternative embodiment of the pre-filled disposable container 10. As illustrated in FIG. 4, a wide variety of products may be sold using the disposable container 10, including milk, juice, and other products, especially products for children. However, the uses of the disposable container 10 should not be construed as being limited to children's products, but may also include products directed to adults, or to other uses.

The terminology used in the specification provided above is hereby defined to include similar and/or equivalent terms, and/or alternative embodiments that would be considered obvious to one skilled in the art given the teachings of the present patent application. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one embodiment, it is to be clearly understood by those skilled in the art that the invention is not limited thereto. Rather, the scope of the invention is to be interpreted only in conjunction with the appended claims.

What is claimed is:

1. A pre-filled disposable container comprising:

a rigid tubular body having an open-ended top and an open-ended bottom, the open-ended top having a top rim, and the open-ended bottom having a vacuum aperture adjacent a bottom rim;

a flexible bag having a top portion with a dispensing aperture, a bottom portion, and an outwardly extending annular flange;

an annular retaining ring that is adapted to lock the outwardly extending annular flange of the flexible bag against the top rim of the rigid tubular body when the flexible bag is positioned within the rigid tubular body;

a cap adapted to fit over the top portion of the flexible bag;

a tear strip removably connecting the cap to the annular retaining ring;

a base sealing element adapted to engage the open-ended bottom of the rigid tubular body and move between a first position, wherein the open-ended bottom is sealed closed, but the vacuum aperture is open, and a second position, wherein both the open-ended bottom and the vacuum aperture are sealed closed;

wherein the open-ended bottom has a bottom inner surface that is adapted to engage an outer perimeter of the base sealing element;

wherein the bottom inner surface is threaded, wherein the outer perimeter of the base sealing element is threaded, and wherein the base sealing element moves between the first and second positions when the base sealing element is rotated with respect to the rigid tubular body; and wherein the base sealing element includes a locking element at a center of the base sealing element that enables the base sealing element to be rotated, thereby moving the base sealing element between the first and second positions.

2. The pre-filled disposable container of claim 1, wherein the outwardly extending annular flange includes a plurality of protections that engage locking apertures in the top rim of the rigid tubular body.

* * * * *